US009518369B2

(12) United States Patent
Ducote et al.

(10) Patent No.: US 9,518,369 B2
(45) Date of Patent: Dec. 13, 2016

(54) EQUIPMENT HOUSING

(71) Applicant: Zip Valve Boxes LLC, Victoria, TX (US)

(72) Inventors: Scott M. Ducote, Victoria, TX (US); Frances M. Kirkland, Victoria, TX (US); Roy P. Prosise, Cedar Park, TX (US); Daniel Francis Caputo, Cedar Park, TX (US); Derek Litteral, Austin, TX (US)

(73) Assignee: ZIP VALVE BOXES LLC, Victoria, TX (US)

( * ) Notice: Subject to any disclaimer, the term of this patent is extended or adjusted under 35 U.S.C. 154(b) by 56 days.

(21) Appl. No.: 14/573,920

(22) Filed: Dec. 17, 2014

(65) Prior Publication Data

US 2015/0176239 A1 Jun. 25, 2015

Related U.S. Application Data

(60) Provisional application No. 61/918,538, filed on Dec. 19, 2013.

(51) Int. Cl.

| | |
|---|---|
| ***E02D 29/14*** | (2006.01) |
| ***E02D 29/12*** | (2006.01) |
| ***B65D 88/76*** | (2006.01) |
| ***B65D 88/78*** | (2006.01) |
| ***B65D 25/00*** | (2006.01) |
| ***E03B 7/09*** | (2006.01) |

(52) U.S. Cl.

CPC ..... *E02D 29/12* (2013.01); *B65D 25/005* (2013.01); *B65D 88/76* (2013.01); *B65D 88/78* (2013.01); *E02D 29/14* (2013.01); *E02D 29/1409* (2013.01); *E03B 7/095* (2013.01); *Y10T 137/7043* (2015.04)

(58) Field of Classification Search

CPC .... E02D 29/14; E02D 29/1409; B65F 1/1447; F16K 27/12; E03B 7/095; G01F 15/18; G01F 15/185; G01F 15/14; H02G 9/10; H02G 9/00; B65D 88/76; B65D 88/78; B65D 25/005

See application file for complete search history.

(56) References Cited

U.S. PATENT DOCUMENTS 2,697,535 A * 12/1954 Olson ..... H02G 3/085 220/3.2

3,131,845 A 5/1964 Gerrard (Continued)

FOREIGN PATENT DOCUMENTS

JP 2011052816 A 3/2011
KR 100949710 B1 3/2010

OTHER PUBLICATIONS

Rain Bird Corporation "Rain Bird VBRND10 10 Round Valve Box With Lid (VB Series Valve Boxes)", Apr. 9, 2010, 4 pgs.

*Primary Examiner* — Andrew Perreault

(57) ABSTRACT

A housing for covering equipment located underground may include a body having a top, a bottom and a pipe aperture. The body may include at least two knockouts formed in the pipe aperture. The knockouts may be configured to be individually and selectively removed from the pipe aperture to adjust a height of the pipe aperture relative to the bottom of the body. In addition, a lid may be configured to be mounted to the body, and the lid is movable between an unlocked position and a locked position.

20 Claims, 9 Drawing Sheets

(56) References Cited

U.S. PATENT DOCUMENTS

| | | | | |
|---|---|---|---|---|
| 3,858,755 | A | 1/1975 | Tellen | |
| 3,877,601 | A * | 4/1975 | Evans | H02G 3/081 220/3.3 |
| RE28,640 | E | 12/1975 | Sauriol | |
| 3,952,908 | A | 4/1976 | Carson | |
| 4,163,503 | A | 8/1979 | McKinnon | |
| 4,333,494 | A | 6/1982 | Shope | |
| 4,691,733 | A | 9/1987 | Zinn | |
| 4,872,575 | A | 10/1989 | Kobilan | |
| D316,975 | S | 5/1991 | Brown | |
| D328,014 | S | 7/1992 | DeCoster | |
| 5,249,697 | A | 10/1993 | McKinnon | |
| 5,333,750 | A | 8/1994 | McKinnon | |
| 5,361,799 | A | 11/1994 | Chilton et al. | |
| D355,478 | S | 2/1995 | Allen | |
| D363,761 | S | 10/1995 | Eggleston | |
| 5,535,915 | A | 7/1996 | McKinnon | |
| D396,090 | S | 7/1998 | Marcichow | |
| D411,609 | S | 6/1999 | Stoltenberg | |
| D428,117 | S | 7/2000 | Minnick | |
| 6,264,056 | B1 | 7/2001 | King | |
| 6,286,702 | B1 | 9/2001 | Buermann | |
| 6,481,593 | B2 * | 11/2002 | Banhagel | A01G 9/10 220/676 |
| D470,921 | S | 2/2003 | Bush | |
| 6,666,349 | B1 | 12/2003 | Gavin | |
| 6,749,080 | B1 | 6/2004 | White | |
| 6,854,616 | B2 | 2/2005 | Steffan | |
| D511,647 | S | 11/2005 | Smith | |
| 7,004,677 | B1 | 2/2006 | Ericksen et al. | |
| 7,117,883 | B1 | 10/2006 | Vitalo | |
| 7,243,810 | B2 | 7/2007 | O'Brien et al. | |
| 7,389,891 | B1 | 6/2008 | Gavin | |
| 7,540,683 | B2 | 6/2009 | Salas | |
| D633,179 | S | 2/2011 | Geideman | |
| 7,922,033 | B2 | 4/2011 | Kearby et al. | |
| 8,193,444 | B2 * | 6/2012 | Rodenberg | H02G 3/086 174/50 |
| D695,878 | S | 12/2013 | Stein | |
| D720,430 | S | 12/2014 | Yoshida | |
| D728,072 | S | 4/2015 | Alexander | |
| D739,500 | S | 9/2015 | Buermann | |
| 2005/0103782 | A1 * | 5/2005 | O'Brien | E03B 7/095 220/4.24 |
| 2006/0169868 | A1 | 8/2006 | Anderson et al. | |
| 2009/0044869 | A1 | 2/2009 | Brown et al. | |
| 2009/0173397 | A1 | 7/2009 | Mallela et al. | |
| 2009/0277910 | A1 | 11/2009 | Buttz | |
| 2011/0006067 | A1 | 1/2011 | Manuel | |
| 2011/0180159 | A1 | 7/2011 | Ericksen | |
| 2012/0247987 | A1 | 10/2012 | Patterson | |
| 2013/0008916 | A1 | 1/2013 | Russo, Jr. | |
| 2013/0341551 | A1 | 12/2013 | Beck | |
| 2014/0166659 | A1 * | 6/2014 | Antal, Sr. | B65D 43/0256 220/521 |
| 2014/0196800 | A1 * | 7/2014 | Buermann | F16K 35/00 137/377 |
| 2014/0263343 | A1 | 9/2014 | Geerligs et al. | |

* cited by examiner

EQUIPMENT HOUSING

This application claims priority to and the benefit of U.S. Pat. App. No. 61/918,538, filed on Dec. 19, 2013, and is incorporated herein by reference in its entirety.

BACKGROUND OF THE INVENTION

Field of the Disclosure

The present invention relates in general to equipment housing and, in particular, to a housing for covering and providing access to subterranean plumbing valves, such as for irrigation systems.

Description of the Related Art

Housings for covering and providing access to subterranean plumbing valves, such as for irrigation systems, are well known in the industry. Some of these housings provide a knockout which can be forcibly removed from the housing. A knockout provides the housing with flexibility in fitting a pipe system. However, prior art housings are limited to single adjustment in this regard. Moreover, removal of the knockout can be difficult and require hand tools to do so. Improvements in irrigation housings continue to be of interest.

SUMMARY

Embodiments of a housing for covering equipment located underground are disclosed. For example, the housing may include a body having a top, a bottom and a pipe aperture. The body may include at least two knockouts formed in the pipe aperture. The knockouts may be configured to be individually and selectively removed from the pipe aperture to adjust a height of the pipe aperture relative to the bottom of the body. In addition, a lid may be configured to be mounted to the top of the body, and the lid is movable between an unlocked position and a locked position.

In other embodiments, the housing may include a body having a pipe aperture with at least one knockout formed in the pipe aperture. In addition, a zipper may be configured to separate the knockout from the body. The knockout can be configured to be selectively removed from the pipe aperture via the zipper to adjust a height of the pipe aperture relative to the bottom of the body.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

DETAILED DESCRIPTION

Figure 1:
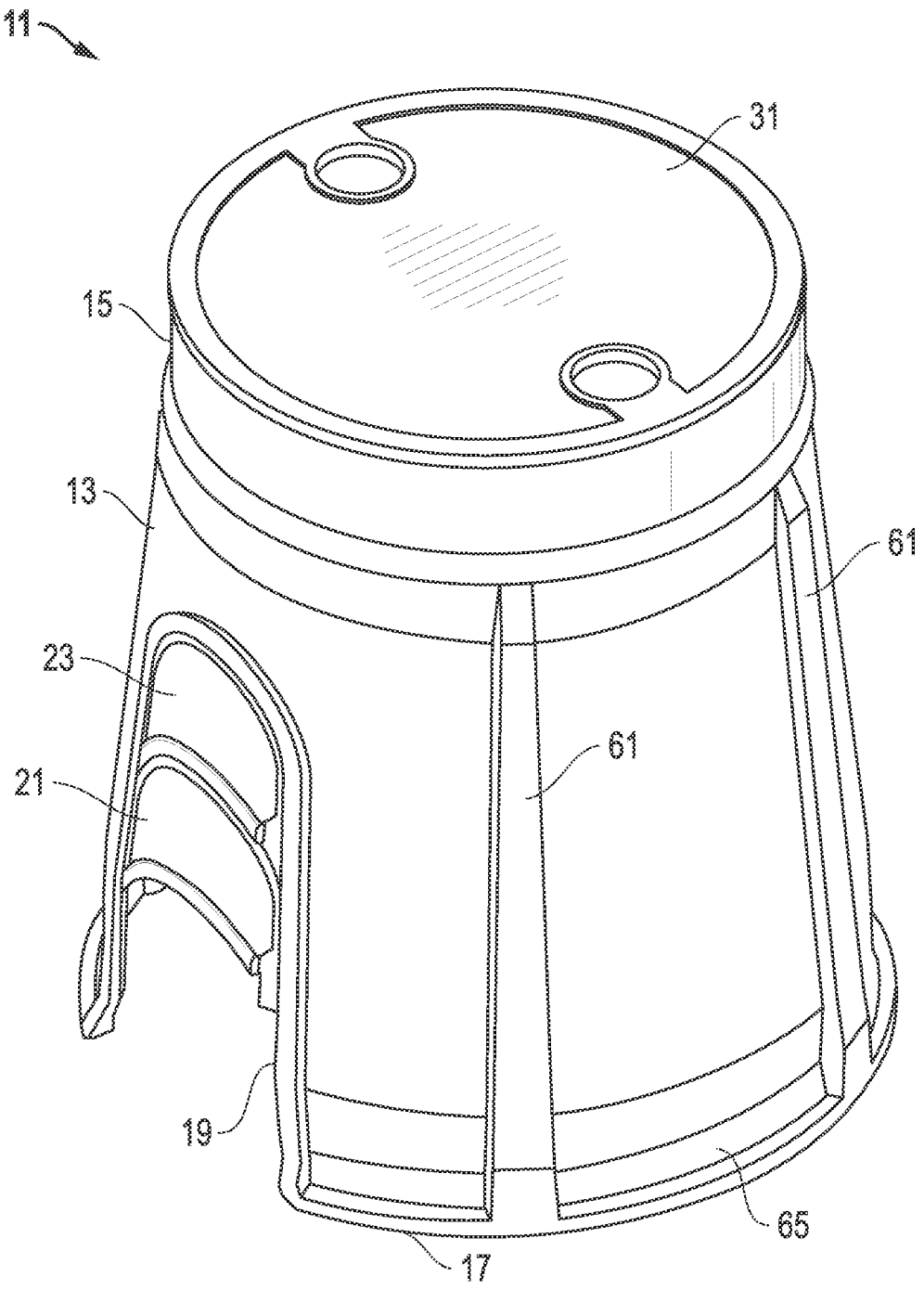
FIG. 1 is a front isometric view of an embodiment of an equipment housing.

Embodiments of an equipment housing are disclosed in FIGS. 1-8. For example, as shown in FIG. 1, a housing 11 for covering equipment located underground may include a body 13 having a top 15, a bottom 17 and an aperture, such as a pipe aperture 19. In some versions (see, e.g., FIG. 6), the body 13 may have more than one pipe aperture 19. Embodiments of the body 13 may consist of only two pipe apertures 19, such as those shown on opposite sides of the body 13.

Some embodiments of the body 13 may include at least two knockouts 21, 23. The knockouts 21, 23 may be formed in the pipe aperture 19. As will be described herein, embodiments of the knockouts 21, 23 are configured to be individually and selectively removed from the pipe aperture 19 to adjust a height H (FIG. 2) of the pipe aperture 19. Height H of pipe aperture 19 may be measured relative to the bottom 17 of the body 13. In some versions, each pipe aperture 19 has at least two knockouts 21, 23, and may consist of only two knockouts 21, 23.

Versions of the knockouts 21, 23 may have various shapes, such as the crescent shapes shown. In some embodiments, the body 13 does not retain the knockouts 21, 23 once the knockouts 21, 23 are removed from it. For example, the body 13 and the knockouts 21, 23 can have no means for reattaching the knockouts 21, 23 to the body 13 once the knockouts 21, 23 are removed from the body 13.

Embodiments of the housing 11 also may include a lid 31. The lid 31 may be configured to be mounted to and removed from the top 15 of the body 13. In addition, the lid 31 may be configured to be movable between an unlocked position (not shown, but illustrated as removed in FIGS. 4 and 7) and a locked position (FIGS. 1-3, 5 and 8).

Figure 2:
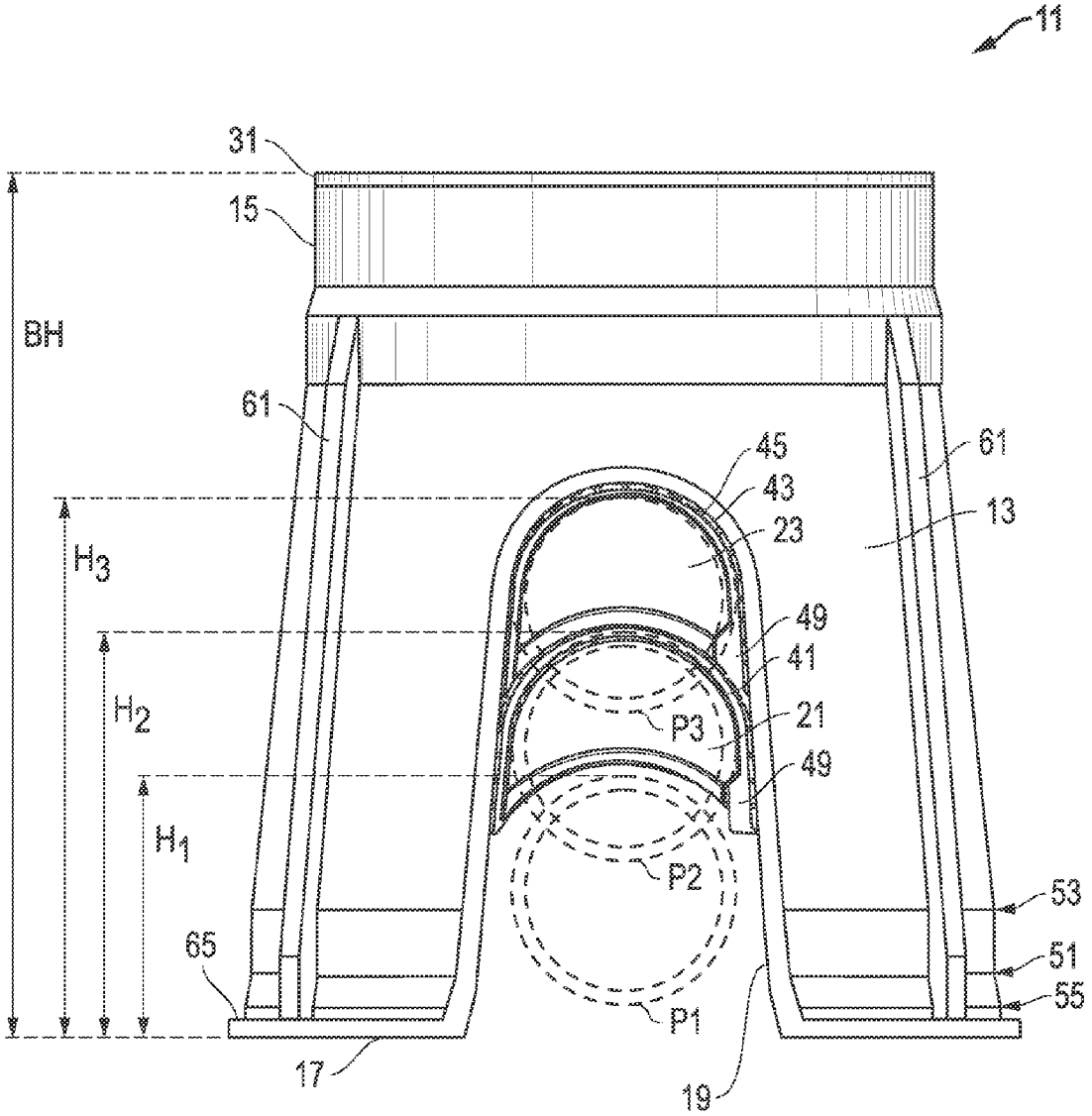
FIG. 2 is an enlarged schematic front view of an embodiment of an equipment housing showing three potential pipe positions.

The body 13 may include a body height BH (FIG. 2). In some embodiments, the pipe aperture 19 has a height H that may be selectively adjustable from about one-third (e.g., H1 in FIG. 2) of the body height BH, to about half (e.g., H2) of the body height BH, to greater than half (e.g., H3) of the body height BH, such as about two-thirds of the body height BH.

Figure 3A:
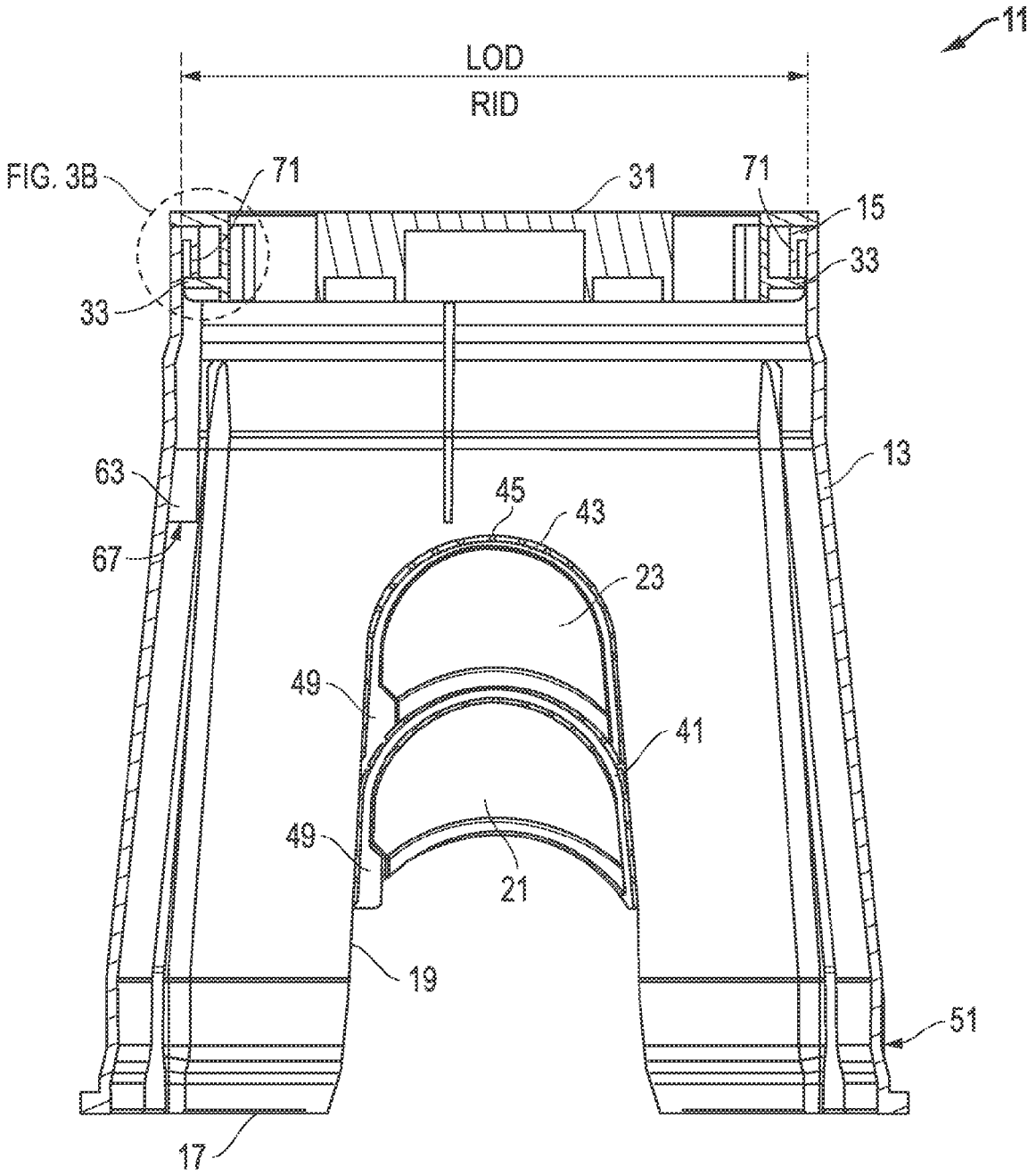
FIG. 3A is a sectional front view of an embodiment of equipment housing.
Figure 3B:
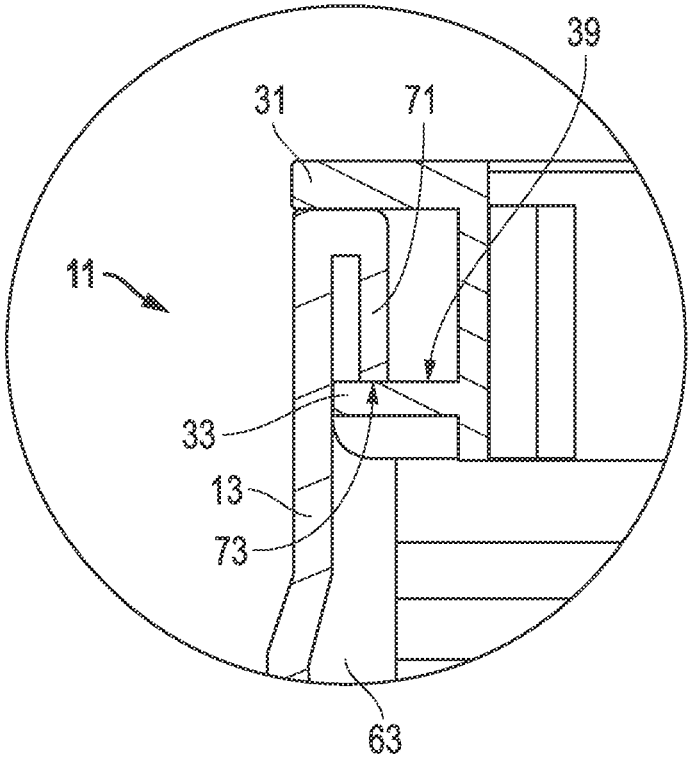
FIG. 3B is a front sectional view of an embodiment of an equipment housing taken along a bisecting line.
Figure 6:
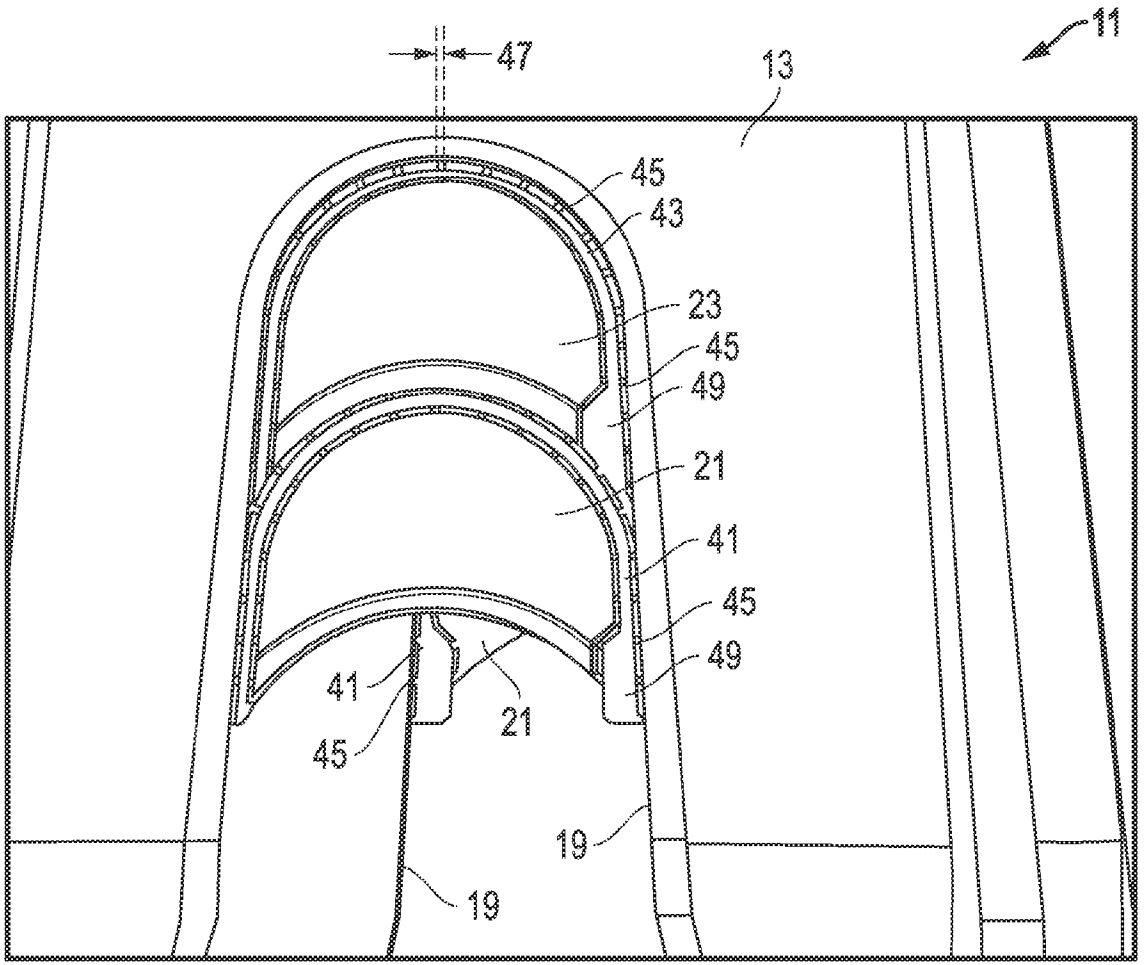
FIG. 6 is an enlarged front view of an embodiment of a portion of an equipment housing.
Figure 7:
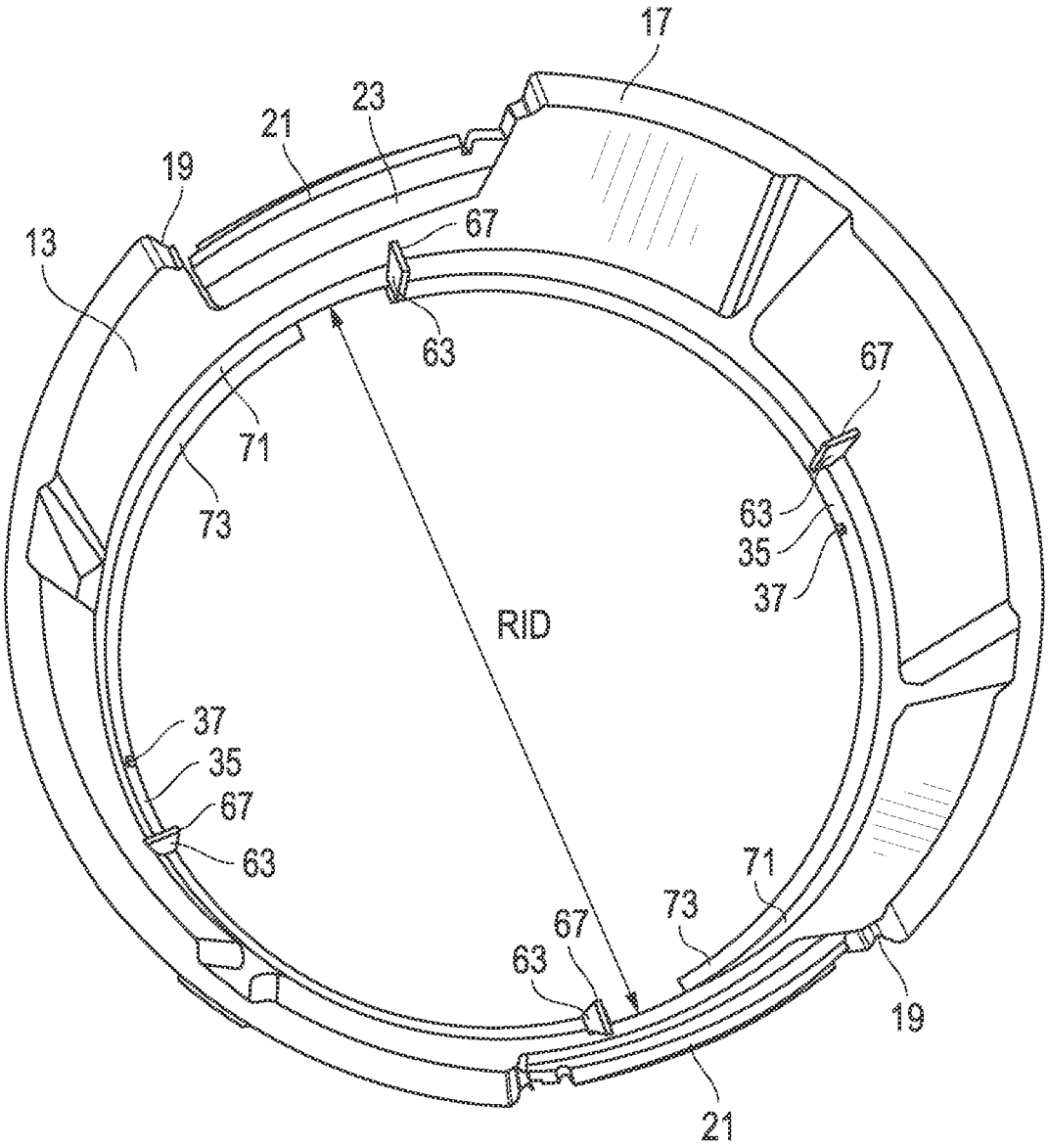
FIG. 7 is a bottom view of an embodiment of an equipment housing with the lid removed.
Figure 8:
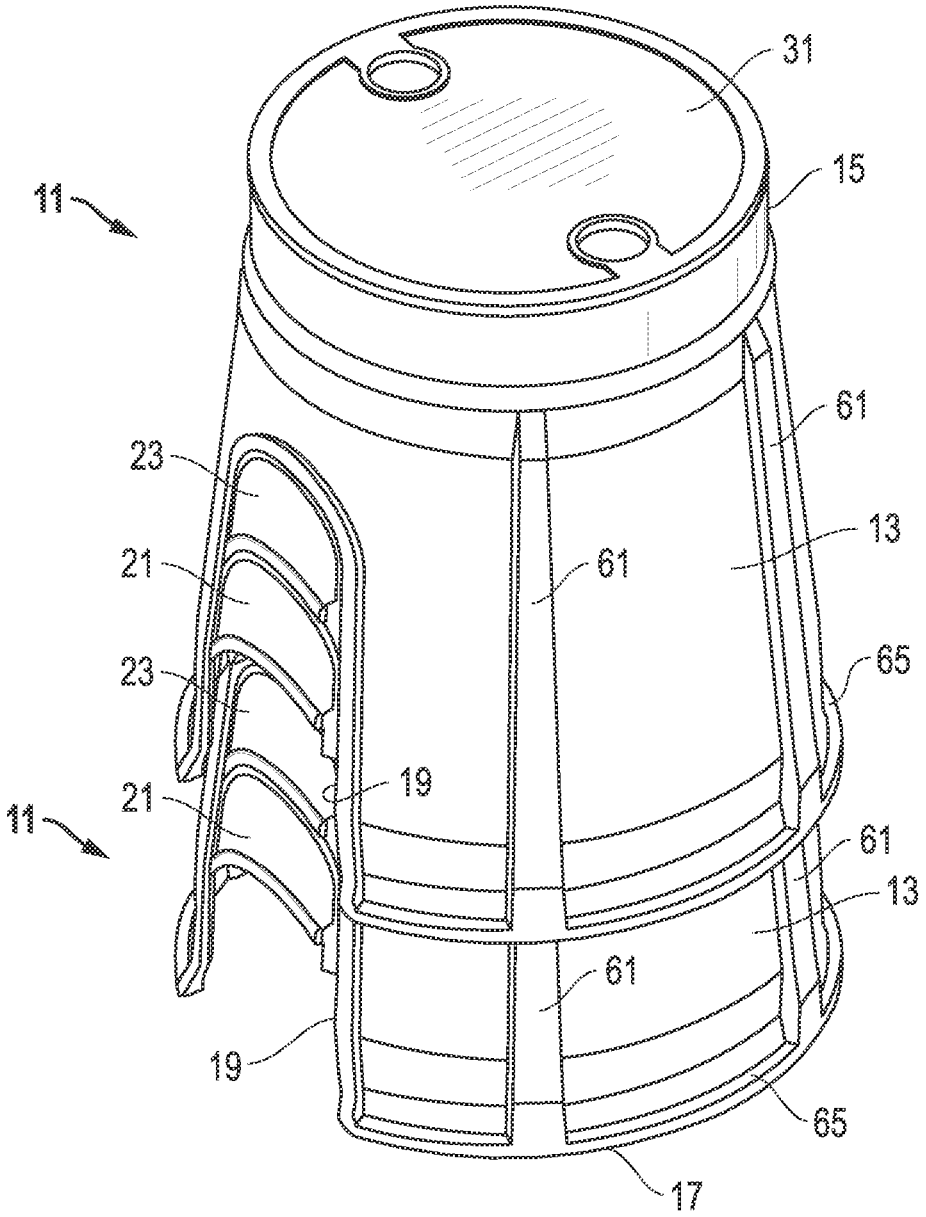
FIG. 8 is a front isometric view of an embodiment of two equipment housings in a stack.

Other embodiments of the housing 11 may further include one or more zippers 41, 43 (FIGS. 2, 3A and 6). The zippers 41, 43 may be provided for assistance to remove the knockouts 21, 23. The zippers 41, 43 may be configured to selectively separate the knockouts 21, 23 pipe aperture 19 in the body 13. In the embodiments shown, zipper 41 is located between knockouts 21, 23. Also in the embodiments shown, zipper 43 is located between the uppermost knockout 23 and body 13. In some versions, the pipe aperture 19 in the body 13 consists of only two zippers 41, 43. In some versions, the zippers 41, 43 are complementary in shape to the knockouts 21, 23. For example, the zippers 41, 43 can be semi-circular.

Some embodiments of the zippers 41, 43 comprise solid bands that are connected only by small tabs 45 (best shown in FIG. 6) that extend from the zippers 41, 43 to adjoining components. For example, zipper 41 may have tabs 45 that extend inwardly to knockout 21, and outwardly to pipe aperture 19, zipper 43 and knockout 23. Zipper 43 may have tabs 45 that extend inwardly to knockout 23 and zipper 41, and outwardly to pipe aperture 19. Versions of the tabs 45 can have a tab thickness 47 that is not greater than about 2 mm, such as not greater than about 1.5 mm, or even not greater than about 1 mm.

Embodiments of each of the zippers 41, 43 may include a handle 49. The handles 49 can have an enlarged size that is larger than the zippers 41, 43. Some versions of the zippers 41, 43 can be configured to be removable from the body 13 by hand without the assistance of a hand tools, such as needle nosed pliers. Embodiments of the zippers 41, 43 can be configured to remain attached to their respective knockouts 41, 43 when the zippers 41, 43 and the knockouts 21, 23 are removed from the pipe aperture 19 in the body 13.

In some embodiments, the body 13 may have a conical shape, as shown. The body 13 also can include a concave portion 51 (FIGS. 2 and 3A) on an outer surface thereof. The concave portion 51 can be reduced in diameter, both from an upper portion 53 located immediately above the concave portion 51, and from a lower portion 55 located immediately below the concave portion 51. In the example shown, the concave portion 51 may be located adjacent the bottom 17 of the body 13.

Versions of the housing 11 may include a body 13 having one or more external vertical ribs 61 (FIGS. 1 and 2), internal vertical ribs 63 (FIGS. 3-5 and 7), and external bottom flange 65. Such features can improve the strength and stackability (FIG. 8) of a plurality of the housings 11, without damaging or partially dislodging the knockouts 21, 23 and zippers 41, 43, prior to use. For example, bottoms 67 (FIG. 3) of internal vertical ribs 63 can engage the top 15 of a nested body 13 (FIG. 8), or the lid 31 of a nested housing 10.

Figure 4:
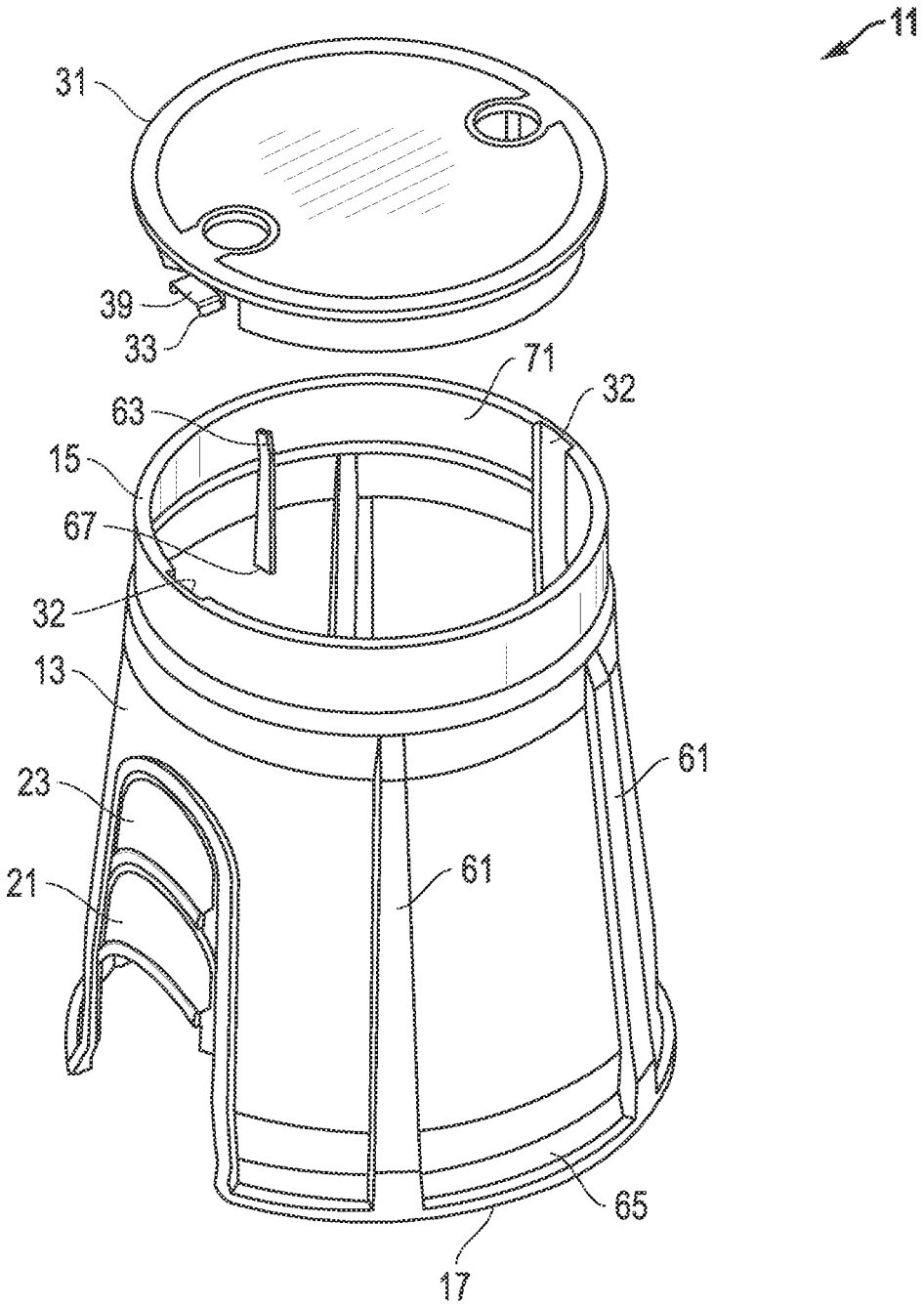
FIG. 4 is a front isometric, exploded view of an embodiment of an equipment housing and lid.
Figure 5:
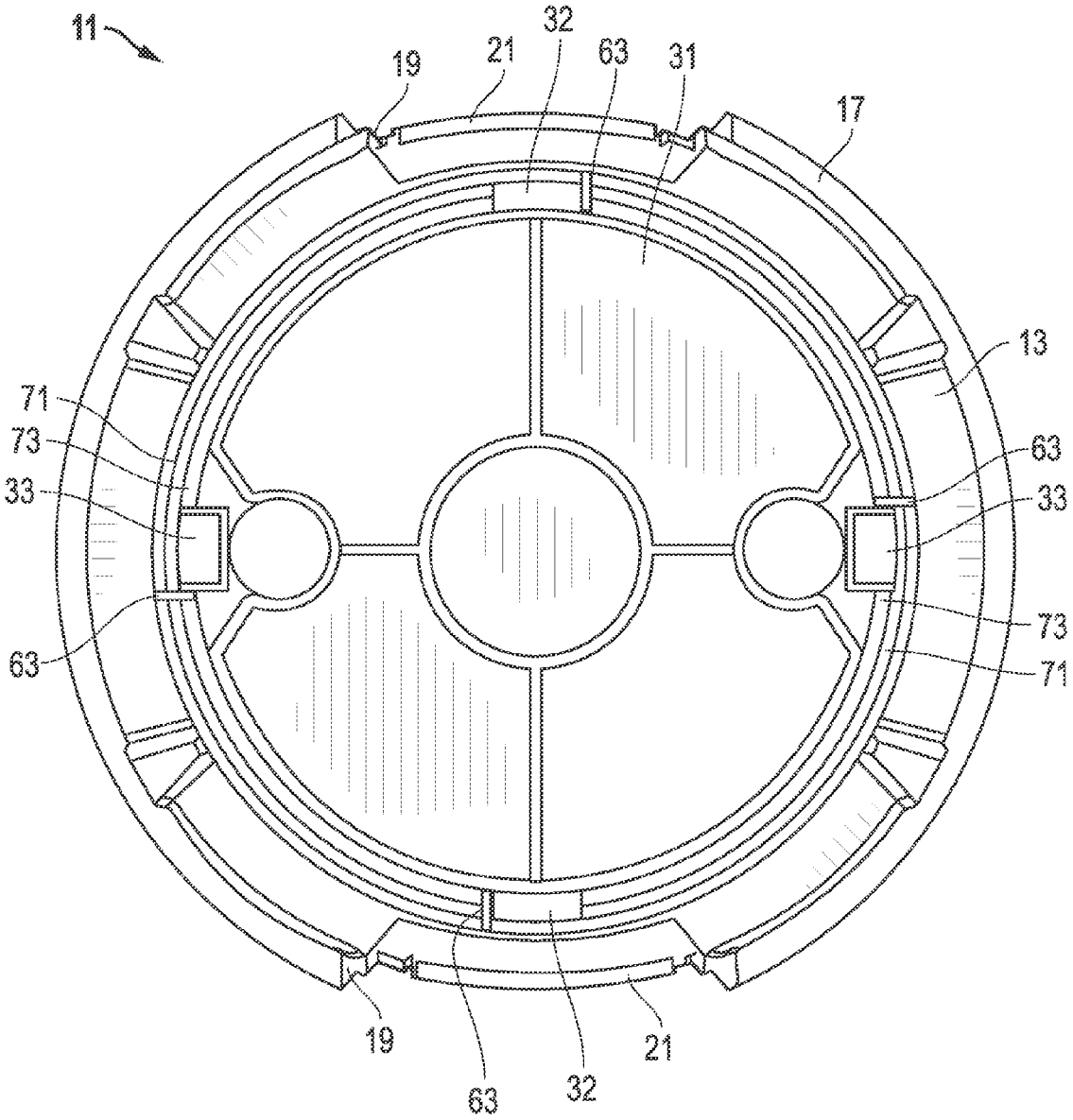
FIG. 5 is a bottom view of an embodiment of equipment housing.

As shown in FIGS. 4 and 5, embodiments of the lid 31 may include one or more flanges 33 (e.g., two shown) extending therefrom. A lid flange outer diameter LOD (FIG. 3A; measured between perimeters of the flanges 33) can be greater than a lid recess inner diameter RID (FIGS. 3A and 7) in the body 13. The lid flanges 33 can be cantilevered, such that they somewhat deflect to accommodate these dimensions.

Embodiments of the lid 31 can be inserted into the top 15 of body 13, such that recesses 32 in body 13 receive flanges 33. Lid 31 can be rotatable between such an unlocked position wherein the lid flanges 33 seat in lid recesses 32 adjacent the top 15 of the body 13, and a locked position (FIGS. 1-3, 5, 8). In the locked position, the tabs 33 of lid 31 can be positively retained in secured recesses 35 (FIG. 7) located within the body 13. For example, each secured recess 35 can have a detent 37 for positively engaging a respective one of the tabs 33, when lid 31 is in the locked position. Embodiments of the body 13 can have inner wall shoulders 71 (FIGS. 3A, 3B and 7) with bottom surfaces 73 configured to slidingly engage upper surfaces 39 of the lid flanges 33 when the lid flanges 33 are rotated from the unlocked position to the locked position.

The embodiments described herein can protect irrigation valves and other components of an irrigation system. The housing has a unique pull-tab feature or zipper that makes it convenient to adjust the size of the pipe hole extending through the housing. One or more materials may be used to form the body and/or lid, such as ABS, propylene, polycarbonate, polyolefin, polyurethane and PVC. In some embodiments, few fillers or no fillers are used in the formulation of the body and/or lid. In a particular embodiment, talc may be used as a filler. The entire body, including the knockouts and zippers, may be formed in a single injection molding operation, for example.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A housing for covering equipment located underground, comprising:

a body having a top, a bottom, side walls and a pipe aperture in each side wall, each pipe aperture comprises at least two knockouts, the knockouts comprise a respective zipper and the knockouts are configured to be individually and selectively removed from the pipe aperture via the respective zipper to adjust a height of the pipe aperture relative to the bottom of the body; and each zipper comprises a band that is connected by tabs to adjoining components of the body.

2. The housing of claim 1, wherein the body comprises a body height, and the pipe apertures comprise a pipe aperture height that is selectively adjustable from about one-third of the body height, to about two-thirds of the body height.

3. The housing of claim 1, further comprising external vertical ribs.

4. The housing of claim 1, further comprising internal vertical ribs.

5. The housing of claim 1, further comprising an external bottom flange.

6. The housing of claim 1, wherein the pipe apertures are on opposite sides of the body.

7. The housing of claim 1, wherein the zippers for each pipe aperture comprise a first zipper located between the knockouts, and a second zipper located between one of the knockouts and the pipe aperture.

8. The housing of claim 1, wherein the zippers are complementary in shape to the knockouts.

9. The housing of claim 1, wherein the tabs have a tab thickness that is not greater than about 2 mm.

10. The housing of claim 1, wherein each zipper comprises a handle that is larger than the zipper.

11. The housing of claim 1, wherein each zipper is configured to remain attached to the knockout when the zipper and the knockout are removed from the body.

12. The housing of claim 1, wherein the knockouts are crescent-shaped and the zippers are semi-circular.

13. The housing of claim 1, wherein the body is conical.

14. The housing of claim 1, wherein the body comprises a concave portion on an outer surface thereof, the concave portion reduces in diameter both from an upper portion located immediately above the concave portion, and from a lower portion located immediately below the concave portion.

15. The housing of claim 1, further comprising a lid configured to be mounted to the top of the body.

16. The housing of claim 15, wherein the lid is movable between an unlocked position and a locked position.

17. The housing of claim 16, wherein the lid comprises lid flanges extending therefrom, and a lid flange outer diameter (LOD) is greater than a lid recess inner diameter (RID) in the body.

18. The housing of claim 16, wherein, in the unlocked position, the lid flanges seat in lid recesses adjacent a top of the body, and in the locked position the lid is positively retained in secured recesses located within the body.

19. The housing of claim 18, wherein each secured recess has a detent for positively engaging a respective one of the lid flanges.

20. The housing of claim 17, wherein the body has inner wall shoulders with bottoms configured to slidingly engage upper surfaces of the lid flanges when the lid flanges are rotated to the locked position.

* * * * *